US005646366A

United States Patent [19]

O'Connell

[11] Patent Number: 5,646,366

[45] Date of Patent: Jul. 8, 1997

[54] UNDERWATER DEFENSE SYSTEM

[75] Inventor: Thomas A. O'Connell, North Kingstown, R.I.

[73] Assignee: The United States of America as represented by the Secretary of the Navy, Washington, D.C.

[21] Appl. No.: 701,322

[22] Filed: Aug. 22, 1996

[51] Int. Cl.[6] ..... F41F 3/10; F41F 5/00; F42B 19/46

[52] U.S. Cl. ..... 114/21.2; 89/1.11; 340/850

[58] Field of Search ..... 114/20.1, 21.1, 114/21.2, 312, 316–318, 326, 328; 367/95, 97, 106, 130, 131, 135, 141, 178; 440/1, 11; 89/1.11; 340/850

[56] References Cited

U.S. PATENT DOCUMENTS

| | | | |
|---|---|---|---|
| 3,783,441 | 1/1974 | Slawsky | 367/5 |
| 5,012,717 | 5/1991 | Metersky et al. | 89/1.11 |
| 5,291,194 | 3/1994 | Ames | 340/850 |
| 5,379,034 | 1/1995 | O'Connell | 340/850 |

*Primary Examiner*—Michael J. Carone
*Assistant Examiner*—Matthew J. Lattig
*Attorney, Agent, or Firm*—Michael J. McGowan; James M. Kasischke; Prithvi C. Lall

[57] ABSTRACT

A communications system of an underwater defense system is decoupled from an unmanned underwater vehicle (UUV) when the UUV is deployed under the surface of the water. A housing attached to the UUV has a communications wire spooled therein with a first end of the wire coupled to the UUV. Once underwater, the housing separates from the UUV causing the communications wire to be paid out from the housing. As a result, a pulling force is applied to the housing via the communications wire. Communications electronics are coupled to a second end of the communications wire. The communications electronics includes an RF antenna switchably coupled to an RF receiver operating at a first frequency and to an RF transmitter operating at a second frequency. A buoy is coupled to the communications electronics to float same to the surface of the water such that the RF antenna breaks the surface of the water. A drag drogue depends from the housing to supply a drag force hat offsets the pulling force to maintain the buoy at the surface of the water and the RF antenna above the surface of the water.

8 Claims, 3 Drawing Sheets

UNDERWATER DEFENSE SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to defense systems, and more particularly to a system in which an unmanned underwater vehicle (UUV) is launched from above the surface of the water and deploys a communications interface for transferring data between the UUV and a remotely located platform above the surface of the water.

(2) Description of the Prior Art

The use of wire guided torpedoes is known in the art of anti-submarine warfare (ASW) or, more generally, for the combatting of any submerged threat. When a wire-guided torpedo is launched from a submarine or other submerged platform, guidance commands can be passed directly over the guidance wire from onboard the submarine. However, if the torpedo is launched from above the surface of the water and is not to be tethered to the launching platform, a communications interface must be provided in order to allow the torpedo to receive guidance commands from the launch or other "above-the-surface" platform.

An air-launched, wire guided torpedo is disclosed in U.S. Pat. No. 3,783,441 in which an air-launched torpedo is tethered to a buoy by means of an electrical control cable. The buoy incorporates an RF receiver system for receiving guidance commands from an airplane. When the torpedo and buoy strike the surface of the water, the buoy remains at the surface of the water while the torpedo begins to swim through the water. However, pulling forces exerted by the torpedo can pull the buoy underwater thereby breaking off guidance command reception with the airplane. In addition, the guidance system relies on a plurality of transmitting sonobuoys deployed at the surface of the water for transmitting acoustic data to the airplane for establishing a contact's position, heading, speed, etc. However, deploying the sonobuoys requires additional time while the presence of the sonobuoys reduces the covertness of the mission.

SUMMARY OF THE INVENTION

Accordingly, it is an object of the present invention to provide a system in which a surface-launched underwater vehicle is capable of maintaining a communication link with the launching or other surface platform once the vehicle is underwater.

Another object of the present invention is to provide a system in which a surface-launched underwater vehicle can covertly maintain a communication link with the launching or other surface platform once the vehicle is underwater.

Other objects and advantages of the present invention will become more obvious hereinafter in the specification and drawings.

In accordance with the present invention, a communications system of an underwater defense system is decoupled from an unmanned underwater vehicle (UUV) when the UUV is deployed under the surface of the water. The communications system serves as a communications interface between the UUV and a remotely located platform above the surface of the water. The system includes a housing with a communications wire spooled therein. The communications wire has a first end and a second end with the first end being coupled to the UUV such that the communications wire is paid out from the housing when the system is decoupled from the UUV. As a result, a pulling force is applied to the housing via the communications wire. Communications electronics are coupled to the second end of the communications wire. The communications electronics include an RF antenna switchably coupled to an RF receiver operating at a first frequency and to an RF transmitter operating at a second frequency. A battery supplies power to the RF receiver and transmitter. A buoy is coupled to the communications electronics to float same to the surface of the water such that the RF antenna breaks the surface of the water. A drag drogue depends from the housing to supply a drag force that offsets the pulling force such that the buoy is maintained at the surface of the water and the RF antenna is maintained above the surface of the water.

BRIEF DESCRIPTION OF THE DRAWING(S)

Other objects, features and advantages of the present invention will become apparent upon reference to the following description of the preferred embodiments and to the drawings, wherein:

FIGS. 1–3 depict a deployment sequence of the underwater defense system according to the present invention in which:

FIG. 1 depicts an unmanned underwater vehicle (UUV) just after being launched from either a surface ship or an aircraft;

FIG. 2 depicts the UUV after it is under the surface of the water at which point the communications system according to the present invention is deployed from the aft end of the UUV;

FIG. 3 depicts the UUV as it swims away from the deployed communications system where an RF antenna is maintained above the surface of the water.

DESCRIPTION OF THE PREFERRED EMBODIMENT(S)

Figure 1:
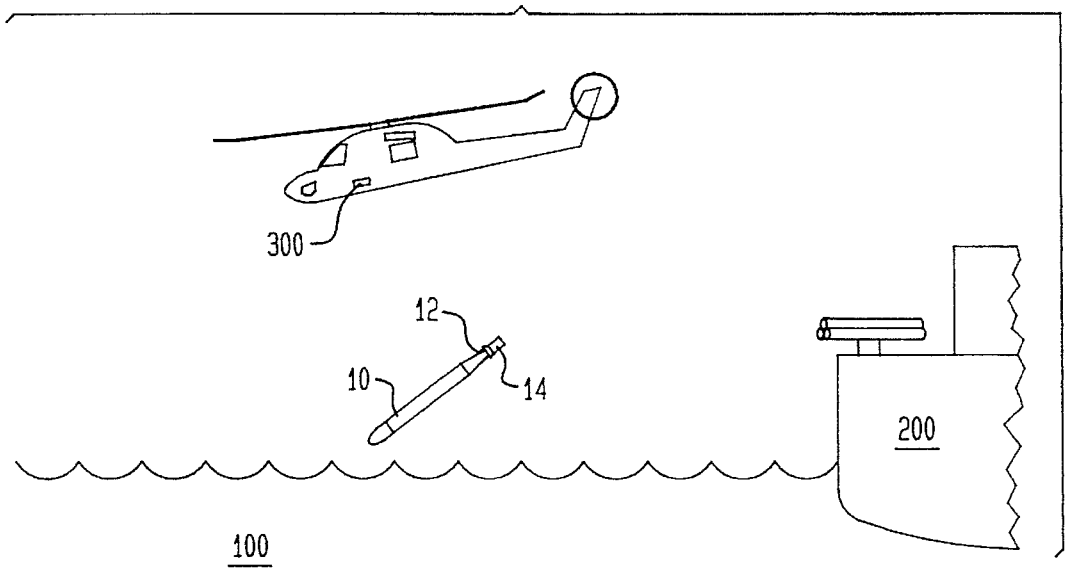
Figure 2:
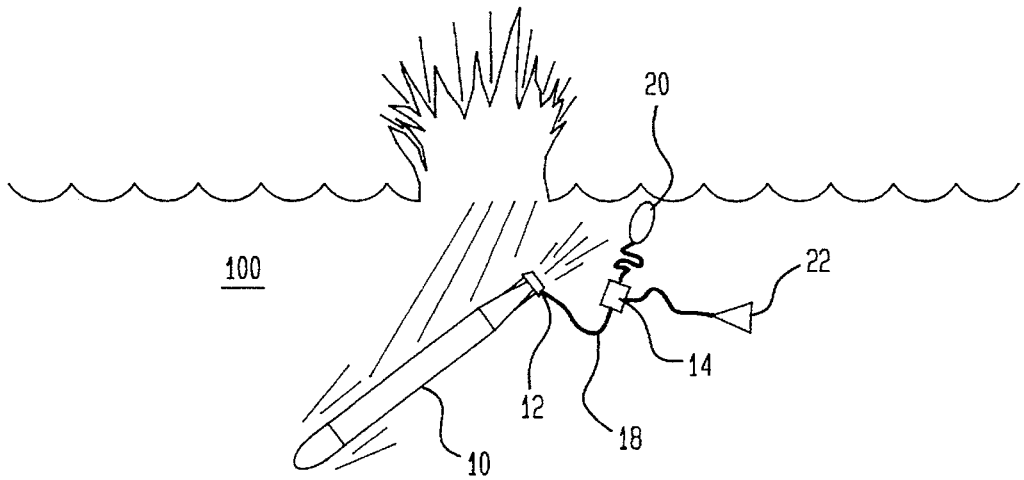
Figure 3:
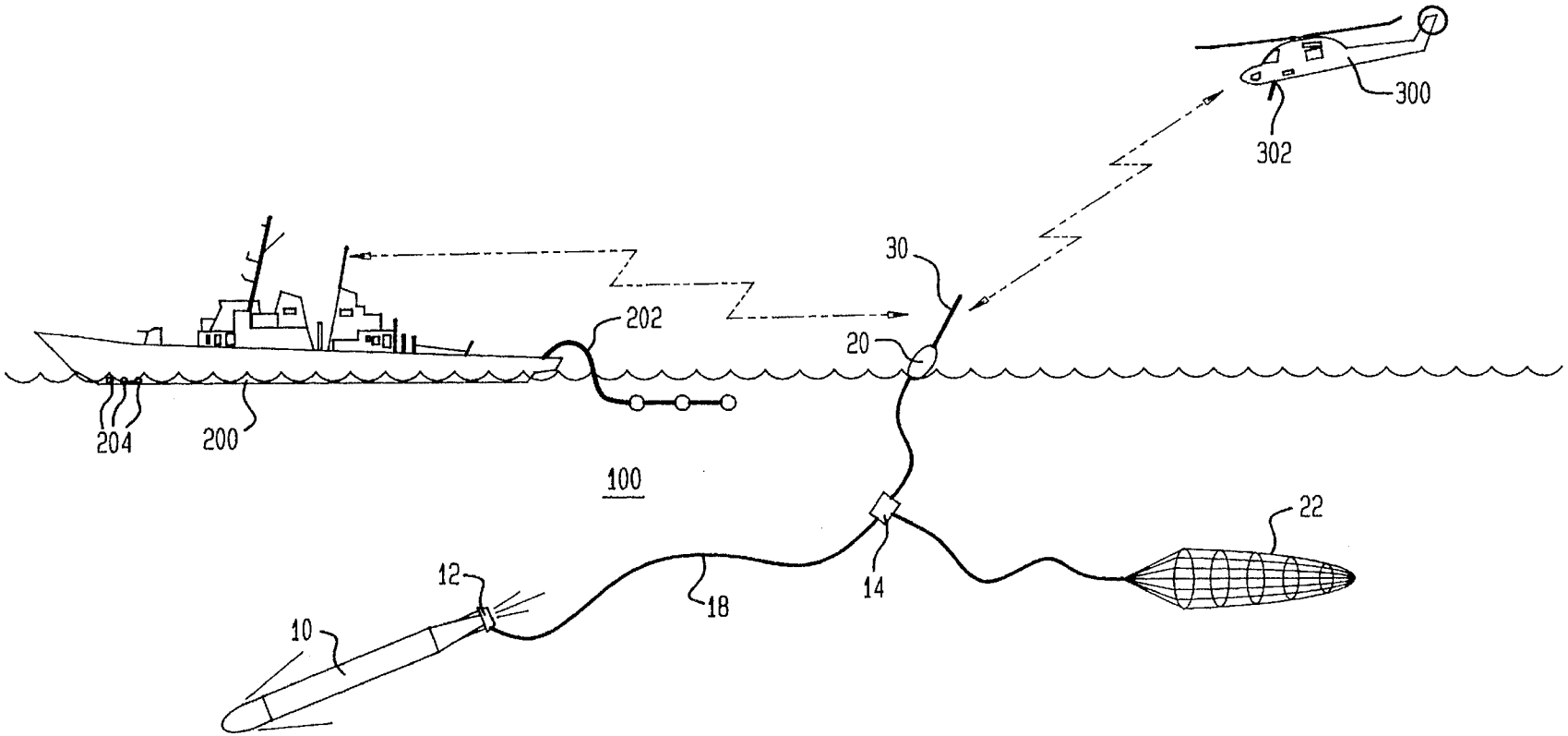

Referring now to the drawings, and more particularly to the sequence depicted in FIGS. 1–3, an unmanned underwater vehicle (UUV) 10 is launched from above the surface of water 100 by either a surface ship 200 or aircraft 300. UUV 10 is typically a torpedo used in anti-submarine warfare or can be any other UUV that needs to communicate with a launch or other platform that resides above the surface of water 100. For purpose of the present invention, it is assumed that UUV 10 is equipped with one or more on board sensors (e.g., sonar hydrophones, video, magnetic detectors or other oceanographic instruments), steering controls and/or defense mechanisms (not shown).

UUV 10 has a propulsor 12 and housing or canister 14 rigidly mounted aft of propulsor 12 prior to being deployed underwater. Canister 14 remains attached to propulsor 12 until propulsor 12 turns on in water 100 at which time canister 14 separates from UUV 10. The attachment/deployment of canister 14 can be modeled after the housings deployed on the aft end of other U.S. Navy underwater vehicles. Basically, the propulsor's shaft (not shown) is screwed into the canister while the canister is prevented from spinning. Thus, when the shaft starts to turn, the canister is unscrewed from the shaft.

Canister 14 houses a spool 16 (shown in FIG. 4) of wire 18 e.g., electrical or optical wire, that is paid out from spool 16 as UUV 10 swims through water 100. One end of wire 18 is coupled to the electronics (not shown) onboard UUV 10. Note that wire 18 could simultaneously be dispensed from the aft end of UUV 10 for hydrodynamic stability. In either case, UUV 10 exerts a substantial pulling force on canister 14 which tends to pull canister 14 in the direction of UUV 10.

As canister 14 separates from UUV 10, the communications system of the present invention is also deployed. More specifically, a gas or otherwise inflatable buoy 20 is deployed from and tethered to canister 14 by a strong tether line 19. The other end of wire 18 is led, either alongside or within tether line 19 as shown, into buy 20 for connection to communications electronics as will be described further below. As shown in FIG. 3, buoy 20 rises to the surface of water 100 and remains there throughout the mission of UUV 10. To assure this, a drag drogue 22 is deployed from canister 14 along with buoy 20. Drag drogue 22 is sized to exert a drag force on canister 14 to offset the pulling force exerted on canister 14 as wire 18 is paid out therefrom. In this way, buoy 20 will be maintained at the surface of water 100.

Figure 4:
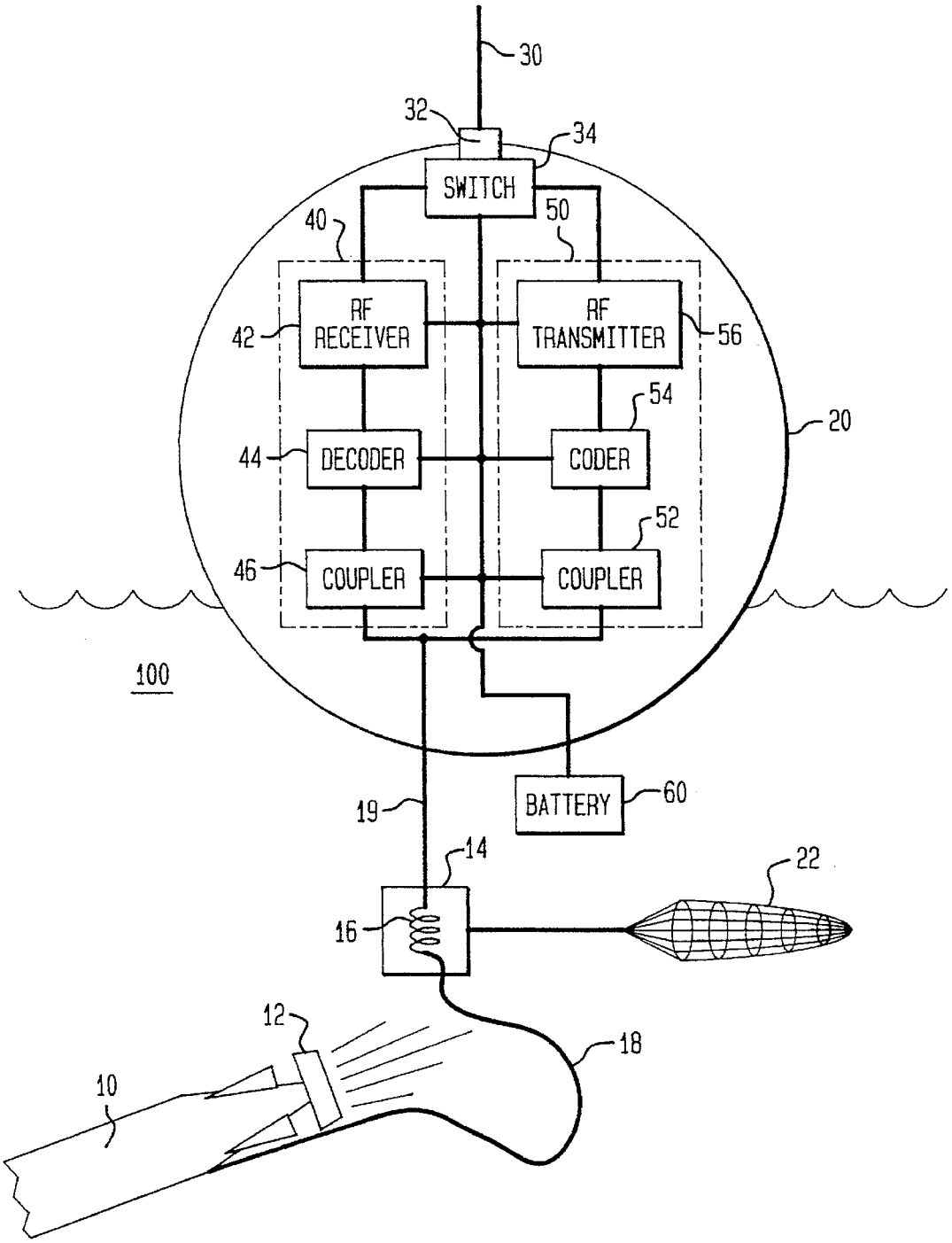
FIG. 4 is a block diagram of the communications electronics floated to and maintained at the surface of the water by the communications system's buoy.

Buoy 20 supports and floats the communications electronics at the surface of water 100. As shown in FIG. 4, an RF antenna 30 protrudes from buoy 20. Ideally, drag drogue 22 acts to align canister 14 under buoy 20 so that antenna 30 is close to being vertical for the best reception and transmission. RF antenna 30 is coupled via antenna coupler 32 to antenna switch 34 which allows RF antenna 30 to both receive and transmit data over different frequencies. A receiver system 40 includes an RF receiver 42 tuned to specific first frequency and coupled to switch 34, a decoder 44 coupled to receiver 42 for reformatting received signals, and coupler 46 for placing the reformatted signals onto wire 18. If wire 18 is an optical wire, coupler 46 is an optical coupler.

A transmitter system 50 includes a coupler 52, e.g., an optical coupler, for receiving signals passed over wire 18, a coder 54 for reformatting the signals received over wire 18 to an RF format, and RF transmitter 56 operating at a second frequency and coupled to switch 34. Power for the above described electronics components can be supplied by, for example, a salt water battery 60.

Referring again to FIG. 3, the communications operation of the present invention will now be described. Once buoy 20 has broken the surface of water 100, RF antenna 30 can begin receiving RF signals on the first frequency from above the surface of water 100 from, for example, ship 200 and/or aircraft 300. Since the above-surface platforms are typically equipped with sophisticated underwater monitoring equipment (e.g., towed array 202, hull-mounted hydrophones 204, aircraft-mounted radar 302, etc.), UUV 10 can receive sophisticated control data without being equipped with sophisticated monitoring equipment. In addition, the data collected by the onboard sensors on UUV 10 can be transmitted via RF communication to ship 200 and/or aircraft 300.

The advantages of the present invention are numerous. A continuous two-way communications link is established and maintained between a UUV and one or more above-the-surface platforms. The communications system includes means for keeping the RF antenna properly positioned at the surface of the water even when the UUV exerts downward pulling forces thereon.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A communications system for an unmanned underwater vehicle (UUV) for communicating between the and a remotely located platform above the surface of a body of water, said system comprising:

housing;

a communications wire spooled within said housing, said communications wire having a first end and a second end, said first end coupled to said UUV such that said communications wire is paid out from said housing when said system is decoupled from said UUV wherein a pulling force is applied to said communications wire;

communications electronics coupled to said second end of said communications wire, said communications electronics including an RF antenna coupled to an RF receiver operating at a first frequency and to an RF transmitter operating at a second frequency, and a battery for supplying power to said RF receiver and said RF transmitter;

a buoy coupled to said communications electronics for floating said RF antenna to the surface of the water such that said RF antenna breaks the surface of the water; and a drag drogue depending from said housing to supply a drag force to offset said pulling force such that said buoy is maintained at the surface of the water and said RF antenna is maintained above the surface of the water.

2. A system as in claim 1 wherein said communications wire is an optical wire.

3. A system as in claim 2 wherein said communications electronics further comprises an optical coupler connected between said second end of said communications wire and said RF receiver and said RF transmitter.

4. A system as in claim 1 wherein said battery is a salt water battery.

5. A system comprising:

a vehicle operating at the surface of the water, said vehicle equipped with onboard sensors for underwater monitoring;

an unmanned underwater vehicle (UUV) launched into the water, said UUV equipped with onboard sensors;

a housing coupled to said UUV until said UUV is underwater;

a communications wire spooled within said housing, said communications wire having a first end and a second end, said first end coupled to said UUV such that said communications wire is paid out from said housing when said housing is decoupled from said UUV wherein a pulling force is applied to said communications wire;

communications electronics coupled to said second end of said communications wire, said communications electronics including an RF antenna switchably coupled to an RF receiver operating at a first frequency and to an RF transmitter operating at a second frequency, and a battery for supplying power to said RF receiver and said RF transmitter, said RF antenna and said RF receiver cooperating to receive data from said vehicle's onboard sensors and pass said data so received to said UUV over said communications wire, and said RF transmitter and said RF antenna cooperating to transmit data passed on said communications wire from said UUV's onboard sensors;

a buoy coupled to said communications electronics for floating said RF antenna to the surface of the water such that said RF antenna breaks the surface of the water; and a drag drogue depending from said housing to supply a drag force that is greater than said pulling force such that said buoy is maintained at the surface of the water and said RF antenna is maintained above the surface of the water.

6. A system as in claim 5 wherein said communications wire is an optical wire.

7. A system as in claim 6 wherein said communications electronics further comprises an optical coupler connected between said second end of said communications wire and said RF receiver and said RF transmitter.

8. A system as in claim 5 wherein said battery is a salt water battery.

* * * * *